United States Patent [19]

Arrington

[11] Patent Number: 4,932,601

[45] Date of Patent: Jun. 12, 1990

[54] REEL LIFT

[76] Inventor: J. W. Arrington, P.O. Box 191, Cason, Tex. 75636

[21] Appl. No.: 319,932

[22] Filed: Mar. 2, 1989

Related U.S. Application Data

[63] Continuation of Ser. No. 125,129, Nov. 25, 1987, abandoned.

[51] Int. Cl.[5] ..... B65H 49/00; B65H 49/32

[52] U.S. Cl. ..... 242/85; 242/129.6; 242/139

[58] Field of Search ..... 242/85, 86.5 R, 129.6, 242/85.1, 129.51, 139; 248/622, 624; 384/440–442; 414/911

[56] References Cited

U.S. PATENT DOCUMENTS

| | | | |
|---|---|---|---|
| 764,344 | 7/1904 | Buckelew | 242/86.5 R |
| 833,963 | 10/1906 | Harrington | 384/440 |
| 1,230,986 | 6/1917 | Bergland | 384/440 |
| 2,484,725 | 10/1949 | Parker | 384/442 |
| 2,913,194 | 11/1959 | Garnett | 242/86.5 R |
| 3,120,358 | 2/1964 | Ensley | 242/129.6 X |
| 3,298,667 | 1/1967 | Grantham et al. | 242/85 |
| 3,968,940 | 7/1976 | Godbersen | 242/86.5 R X |
| 4,093,164 | 6/1978 | Borreson | 248/624 |
| 4,119,343 | 10/1978 | Pentzien | 248/622 X |
| 4,469,289 | 9/1984 | Gebo | 242/85 |
| 4,705,283 | 11/1987 | Kleisath | 242/86.5 R |
| 4,755,830 | 7/1988 | Plunk | 248/514 X |

*Primary Examiner*—Stuart S. Levy
*Assistant Examiner*—Steven M. duBois
*Attorney, Agent, or Firm*—John M. Harrison

[57] ABSTRACT

A reel lift which includes a pair of cooperating lifting members, each characterized by a base constructed of angle iron and fitted with an upward-standing trunk which is also constructed of angle iron, which trunk divides the base into a foot portion and a heel portion of dissimilar size. A handle is welded or otherwise fixedly attached to the upward-standing trunk and a support sleeve is secured to the trunk in transverse relationship with respect to the handle and the base, in order to facilitate insertion of a support pipe for utilizing the reel lift members in concert to support a reel therebetween.

12 Claims, 1 Drawing Sheet

FIG. 1
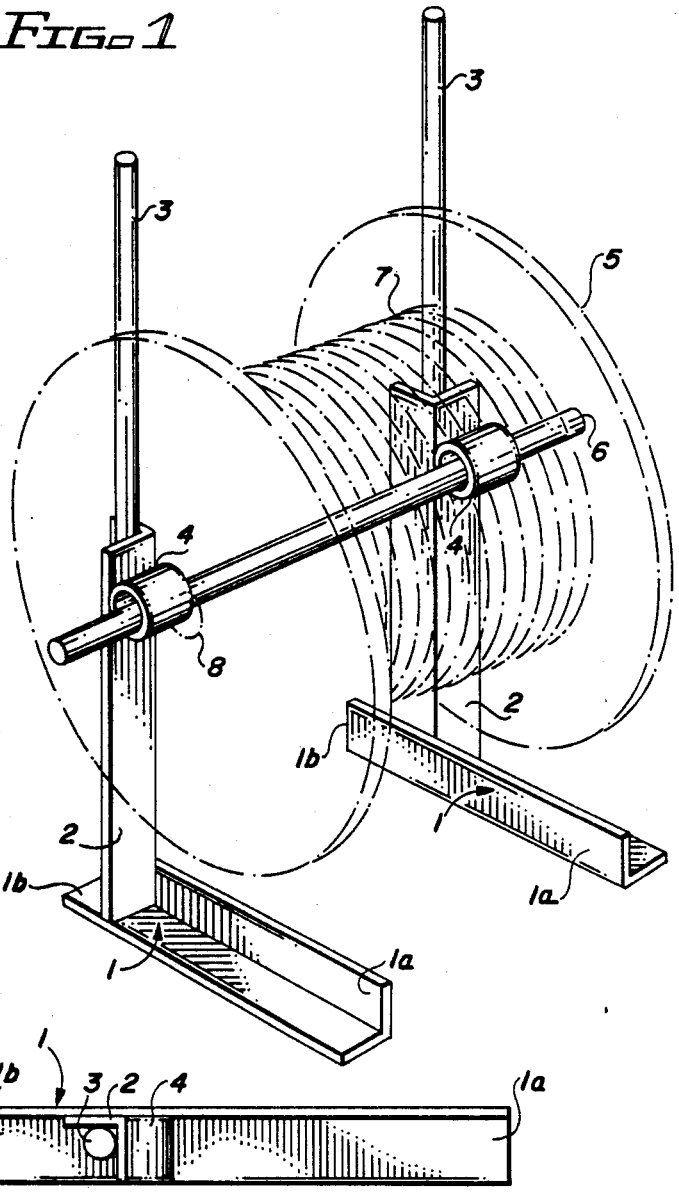
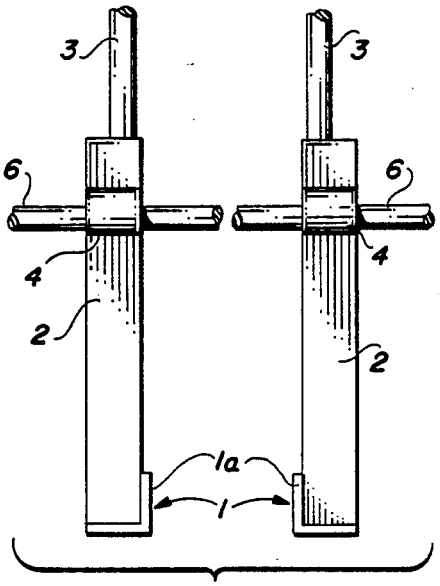
FIG. 2
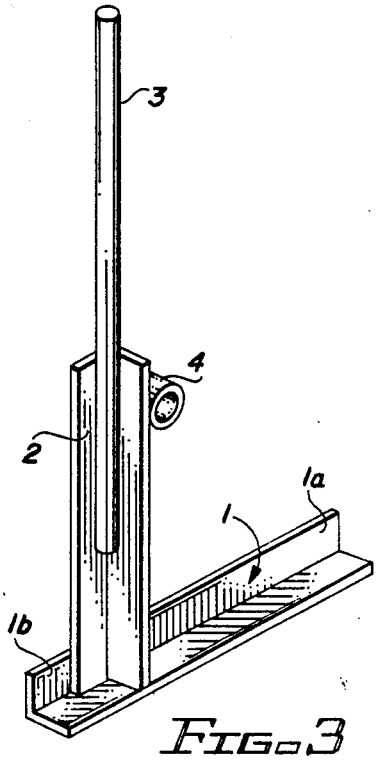
FIG. 3
FIG. 4
FIG. 5
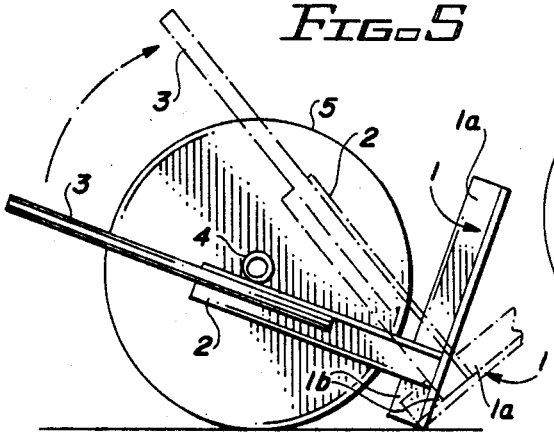
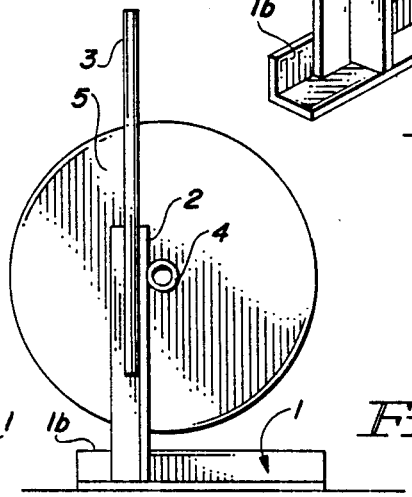
FIG. 6

REEL LIFT

This is a continuation of co-pending application Ser. No. 07/125,129 filed on 11/25/87 now abandoned.

SUMMARY OF THE INVENTION

The Reel Lift is a 2'×5' L shaped tool made of steel products such as angle, channel, box and pipe, and is designed for the purpose of lifting and holding in place the reels containing materials such as wire, chain, rope, cable, etc., so the reel can be rotated freely for the removal of the materials.

BRIEF DESCRIPTION OF THE DRAWINGS

Detail A is a side view away from the reel showing the base (1) divided into the foot(a) and heel(b), trunk(2), handle(3), and support sleeve(4).

Detail B is a view from the foot end of the base(1), showing the base(1), trunk(2), handle(3), support sleeve(4) and overhang(5) of the support sleeve(4) on the trunk(2). The purpose of the overhang(5) is to prevent the uneven parts of the reel from catching on the lift trunk(2) as the reel is turned.

Detail C is the same as A, except with dimensions.

DESCRIPTION OF THE PREFERRED EMBODIMENTS

Detail D First, place the reel so that the lifting hole is horizontal. Detail E Next, install a pipe that is large enough to carry the weight of the reel through the lifting hole of the reel, extending from both sides approximately 12". Detail F Then, with the heel(b) down and the flat side of the trunk(2) toward the reel, with trunk(2) under support pipe, place support sleeve(4) over support pipe and against reel. Repeat for the other hand. Detail G Lift handles to vertical position. The reel can now be turned freely for the removal of the material.

The Reel Lift consists of a base(1) made of 3"×3"×¼" angle iron 2' long, which is divided into a foot(a) and heel(b) to which a trunk(2) is welded consisting of a 3"×3"×¼" angle iron 2' long. The position to weld the trunk(2) to the base(1) is determined by the following:

Lay the base(1) on a horizontal surface so that one leg lays flat with the surface, and the other leg points vertical. Next, from one end of the base(1), measure off 6"; this part of the base(1) is the heel(b), the other 18" is the foot(a). Stand the trunk(2) vertically on the 6" mark with the opening facing outward toward the heel(b) of the base(1) and weld.

A handle(3) made of 1" I.D. pipe 0.125 gauge steel 4' long is then welded to the trunk(2) at the junction point of the angle iron inside the webb, beginning approximately 1' from the end opposite the base(1) and extending 3' beyond the end of the trunk(2) away from the base(1).

A support sleeve(4) made of 3" I.D. pipe 0.125 gauge 5" long is then welded perpendicular on the trunk(2) 22" on center from the base(1) and on the flat side facing the foot(a) of the base(1).

The Reel Lift is used in pairs, right and left hand. The hand is determined by standing at the heel(b) end of the base(1). If the vertical leg of the base(1) is to the right, it will be a left hand lift, and if the vertical leg of the base(1) is to the left, it will be a left hand lift.

Having described my invention with the particularity set forth above, what is claimed is:

1. A reel lift comprising a pair of lift devices adapted for disposal on each side of a reel and lifting said reel, said lift devices each comprising a base member; a trunk upward-standing from said base member, with one end of said trunk fixedly secured to said base member a first predetermined distance from one end of said base member to define a foot portion and a second predetermined distance from the opposite end of said base member to define a heel in said base member, said foot portion, said heel portion and both ends of said base member being collinear, wherein said first predetermined distance is greater than said second predetermined distance; a handle carried by said trunk for manipulating said lift devices, respectively; a cylindrical sleeve fixedly secured to said trunk in substantially transverse relationship with respect to said trunk and substantially parallel to said base member, said sleeve extending beyond the vertical plane of said trunk on each side of said trunk for engaging the reel and preventing the reel from contacting said trunk when said lift devices are placed on each side of the reel; and elongated support means adapted to extend through the center of the reel in transverse relationship and engage said sleeve in each of said lift devices for lifting said reel and suspending said reel on said support means between said lift devices, responsive to manipulation of said handle on each of said lift devices.

2. The reel lift of claim 1 wherein said base member is further characterized by a first length of angle iron and said trunk is further characterized by a second length of angle iron.

3. The reel lift of claim 1 wherein said handle is tubular and welded to said trunk.

4. The reel lift of claim 1 wherein:

(a) said base member is further characterized by a first length of angle iron and said trunk is further characterized by a second length of angle iron; and (b) said handle is cylindrical and welded to said trunk.

5. The reel lift of claim 1 wherein said sleeve is characterized by a tubular sleeve pipe welded to said trunk and wherein said support means slidably engages said sleeve pipe for lifting the reel.

6. The reel lift of claim 1 wherein:

(a) said sleeve is characterized by a tubular sleeve pipe welded to said trunk and said support means slidably engages said sleeve pipe for lifting the reel;

(b) said base member is further characterized by a first length of angle iron and said trunk is further characterized by a second length of angle iron; and (c) said handle is cylindrical and welded to said trunk.

7. The reel lift of claim 1 wherein said support means is characterized by a tubular support pipe and said sleeve is characterized by a tubular sleeve pipe having an inside diameter which is larger than the outside diameter of said support pipe.

8. A reel lift comprising a pair of lift devices adapted for disposal on each side of a reel and lifting said reel, said lift devices each comprising a base member; a handle upward-standing from said base member, with one end of said handle fixedly secured to said base member between the ends of said base member a first predetermined distance from one end of said base member to define a foot portion and a second predetermined distance from the opposite end of said base member to define a heel portion, said foot portion, said heel portion and both ends of said base member being collinear, wherein said first predetermined distance is greater than said second predetermined distance; a tubular sleeve fixedly secured to said handle in substantially transverse relationship with respect to said handle, said sleeve extending beyond the vertical plane of said handle on each side of said handle for engaging the reel and preventing the reel from contacting said handle when said lift devices are placed on each side of the reel; and elongated support means adapted to extend transversely through said reel and engage said sleeve in said lift devices, for lifting said reel and suspending said reel on said support means between said lift devices responsive to manipulation of said handle on each of said lift devices.

9. The reel lift of claim 8 wherein said sleeve is characterized by a tubular sleeve pipe welded to said handle and wherein said support means slidably engages said sleeve pipe for lifting the reel.

10. The reel lift of claim 8 wherein said base member is further characterized by a first length of angle iron and said handle is further characterized by an elongated rod and a second length of angle iron having one end welded to said rod, with the opposite end of said second length of angle iron welded to said first length of angle iron.

11. The reel lift of claim 8 wherein said support means is characterized by a tubular support pipe and said sleeve is characterized by a tubular sleeve pipe having an inside diameter which is larger than the outside diameter of said tubular support pipe.

12. A reel lift comprising a pair of lift devices adapted for disposal on each side of a reel and lifting said reel, said lift devices each comprising a base member adapted for resting on a supporting surface; a trunk upwardstanding from said base member, with one end of said trunk fixedly secured to said base member a first predetermined distance from one end of said base member to define a foot portion and a second predetermined distance from the opposite end of said base member to define a heel portion extending in opposite directions from said one end of said trunk in said base member, said foot portion, said heel portion and both ends of said base member being collinear, wherein ssaid first predetermined distance is greater than said second predetermined distance; a handle carried by the opposite end of said trunk for manipulating said lift devices, respectively; a tubular sleeve fixedly secured to said trunk in substantially transverse relationship with respect to said trunk and substantially parallel to said base member, said sleeve extending beyond the vertical plane of said trunk on each side of said trunk for engaging the reel and preventing the reel from contacting said trunk when said lift devices are placed on each side of the reel; and an elongated tubular support adapted to extend through the center of the reel in transverse relationship, with the ends of said support inserted in said sleeve in each of said lift devices, respectively, for lifting said reel and suspending said reel on said support between said lift devices responsive to manipulation of said handle on each of said lift devices.

* * * * *